United States Patent [19]

Kaye

[11] Patent Number: 4,911,095

[45] Date of Patent: Mar. 27, 1990

[54] COLLAPSIBLE BOAT WITH REMOVABLE TRANSOM PANEL

[76] Inventor: Alex R. Kaye, 88 Shearer Dr., Atherton, Calif. 94025

[21] Appl. No.: 174,569

[22] Filed: Mar. 29, 1988

[51] Int. Cl.[4] ..... B63B 7/00

[52] U.S. Cl. ..... 114/354

[58] Field of Search ..... 114/354

[56] References Cited

U.S. PATENT DOCUMENTS

| | | | |
|---|---|---|---|
| 2,346,081 | 4/1944 | Randrup | 114/354 |
| 2,353,013 | 7/1944 | Clark | 114/354 |
| 3,032,784 | 5/1962 | Randrup | 114/354 |
| 3,108,295 | 10/1963 | Schor et al. | 114/354 |
| 3,139,634 | 7/1964 | Craft | 114/354 |
| 3,228,042 | 1/1966 | Ogimoto | 114/354 |
| 3,648,309 | 3/1972 | Novakovich | 114/354 |

*Primary Examiner*—Joseph F. Peters, Jr.
*Assistant Examiner*—Thomas J. Brahan
*Attorney, Agent, or Firm*—Townsend and Townsend

[57] ABSTRACT

A collapsible boat having a pair of side panels and a pair of bottom panels with contiguous edges of adjacent side and bottom panels being hingedly coupled together so that the panels can move from collapsed positions in which they are in side-by-side relationship to expanded positions in which they form the boat with an open rear end. A transom panel is removably mounted on the boat in closing relationship to the open rear end of the boat. Mounting of the transom panel can be accomplished by the use of channel members which receive the side margins of the transom panel. A flexible sealing sheet of plastic or other water impervious material is provided to seal the open rear end of the boat. Thus, there will be no leakage of water into the boat, and the boat will be water-tight, notwithstanding the removability of the transom panel from the boat. The transom panel, when so mounted, can be used to mount an outboard motor on the boat. An improved carriage allows the boat, when expanded and having an outboard motor, to be easily moved over land, yet the carriage is simple and rugged in construction, is in expensive to produce, and can be quickly and easily removed from the boat.

6 Claims, 3 Drawing Sheets

COLLAPSIBLE BOAT WITH REMOVABLE TRANSOM PANEL

BACKGROUND OF THE INVENTION

1. Field of the Invention

This invention relates to improvements in collapsible boats and, more particularly, to such a boat having a rigid rear transom panel which can be removed from the boat to allow the boat to collapse.

2. Description of the Prior Art

In U.S. Pat. No. 3,482,368, there is disclosed a collapsible boat having two bottom panels and two side panels, adjacent panels being connected together by hinges which allow the panels to be moved from expanded positions into side-by-side relationship with each other to form a compact unit capable of being carried easily by hand or on a vehicle. The shape of the side and bottom panels of the boat are such that substantially no room or very little space is left for mounting an outboard motor on the boat in the event that the boat is to be powered by such a motor. In U.S. Pat. No. 4,556,009, improvement of the collapsible boat is shown wherein the side and bottom panels converge toward each other at the rear end of the boat, yet a small space is available for securing a plate thereon, the plate being used for mounting an outboard motor on the boat. The boats of both disclosures generally require rear stabilizing flaps to stabilize the boats and to keep the stern of each boat from sinking in the water.

It is desirable to have a large motormounting unit at the rear of a collapsible boat to accommodate a heavier motor while eliminating the need for the above-mentioned stabilizing flaps. Moreover, a wider stern gives much greater buoyancy. Thus, a need exists for improvements in a collapsible boat and the present invention satisfies this need.

SUMMARY OF THE INVENTION

The present invention is directed to a collapsible boat having a pair of side panels and a pair of bottom panels with contiguous edges of adjacent side and bottom panels being hingedly coupled together so that the panels can move from collapsed positions in which they are in side-by-side relationship to expanded positions in which they form the boat with an open rear end. A transom panel is removably mounted on the boat in closing relationship to the open rear end of the boat. Mounting of the transom panel can be accomplished by the use of channel members which receive the side margins of the transom panel. A flexible sealing sheet of plastic or other water impervious material is provided to seal the open rear end of the boat. Thus, there will be no leakage of water into the boat, and the boat will be water-tight, notwithstanding the removability of the transom panel from the boat. The transom panel, when so mounted, can be used to mount an outboard motor on the boat.

Another aspect of the invention is the use of an improved carriage which allows the boat, when expanded and having an outboard motor, to be easily moved over land, yet the carriage is simple and rugged in construction, is inexpensive to produce, and can be quickly and easily removed from the boat.

The primary object of the present invention is to provide an improved collapsible boat having a removable transom panel across an open rear end of the boat wherein the boat is sealed at the open rear end thereof to render the boat watertight notwithstanding the removability of the transom panel from the boat.

Another object of the present invention is to provide an improved carriage for a boat of the type described when the boat is expanded and having an outboard motor thereon, wherein the carriage is simple and rugged in construction, is simple to produce and maintain, and can be used by a single person to move the boat.

Other objects of this invention will become apparent as the following specification progresses, reference being had to accompanying drawings for an illustration of the invention.

DETAILED DESCRIPTION OF THE PREFERRED EMBODIMENTS

Figure 1:
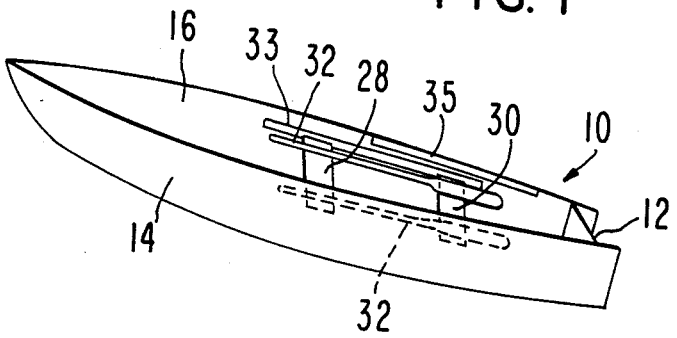
FIG. 1 is a perspective view of a collapsible boat having a rear transom panel removably spanning the distance between the sides of the boat across the open rear end thereof.

The collapsible boat of the present invention is broadly denoted by the numeral 10 and is shown in FIG. 1. Boat 10, when expanded as shown in FIG. 1, has an open rear end and includes a transom panel 12 removably mounted thereon across the open rear end thereof to close such rear end. The way in which the open rear end is closed and sealed is an important feature of the present invention as hereinafter described.

Figure 5:
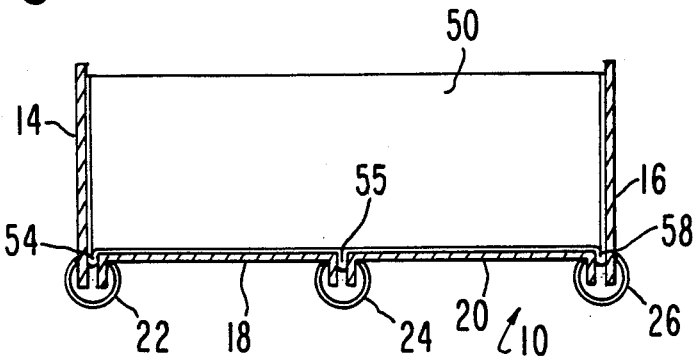
FIG. 5 is a rear elevational view of the boat, showing the sealing sheet coupled to the boat.

Boat 10 is comprised of a number of hingedly interconnected panels including a pair of spaced side panels 14 and 16 and a pair of bottom panels 18 and 20. Panels 14 and 18 are hingedly interconnected at their adjacent longitudinal edges by a hinge 22, adjacent longitudinal edges of panels 18 and 20 are interconnected by a hinge 24, and adjacent longitudinal edges of 16 and 20 are interconnected by panels a hinge 26. These hinges are shown in FIG. 5 and typically are of the same construction as the hinges found in U.S. Pat. No. 3,482,368.

The side and bottom panels of boat 10 are preferably made from a suitable plastic material such that they present a buoyant hull when the boat is expanded. The panels are initially collapsible at the side hinges 22 and 26 so that the boat can be partially collapsed into the condition shown in FIG. 4. The boat can then be fully collapsed by moving the bottom panels toward each other about the hinge axis of hinge 24. The side panels are between the bottom panels when the boat is fully collapsed.

Boat 10 can be quickly and easily expanded into a condition shown in FIG. 1, whereupon transom panel 12 can be fitted into place as hereinafter described and seat boards 28 and 30 (FIG. 1) can be coupled with channel-shaped side stiffeners 33 fixed to the inner surfaces of side panels 14 and 16. Stiffeners 33 are used to stiffen the side panels 14 and 16 of boat 10 to keep the side panels from warping or bending out of shape when the boat is expanded into the condition and under power in the water. Foam flotation members 35 may be secured to the inner surfaces of side panels 14 and 16 near the top margins and on the upper surfaces of seat boards 28 and 30 to provide buoyancy and stability if boat 10 is swamped. A pair of paddles 32 can also be provided, if desired.

Figure 6:
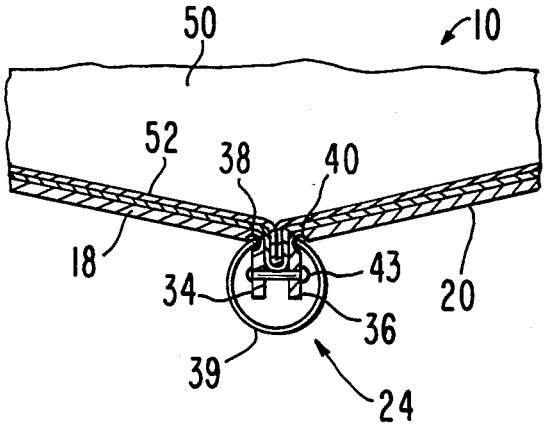
FIG. 6 is a view similar to FIG. 5 but showing an enlarged view of the central hinge coupling the two bottom panels together.

Each of hinges 22, 24 and 26 is of the type shown in FIG. 6 wherein hinge 24 is illustrated. The hinge includes a pair of side strips 34 and 36 which are integral with respective bottom panels 18 and 20 and which are made pivotal by recesses 38 and 40 (FIG. 6) at the junctions of strips 34 and 36 and respective bottom panels 18 and 20. Thus, strips 34 and 36 can be pivoted easily relative to the respective bottom panels 14, 18 and 20. A U-shaped connector 39 extends along the length of strips 34 and 36 and covers the strips when fasteners 43 interconnect the strips 34 and 36.

By virtue of hinges 22, 24 and 26, the boat can be collapsed into a compact form with all panels 14, 16, 18 and 20 being side by side and forming a flat, compact unit capable of being hand carried or coupled to the side of a vehicle.

Figure 2:
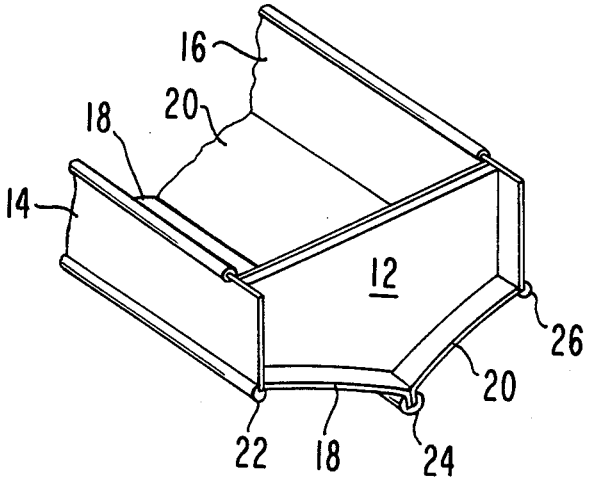
FIG. 2 is a fragmentary, perspective view of the boat, showing the removable panel in place.

Transom panel 12 has the shape shown in FIG. 2 wherein the panel is made of wood, metal or plastic and has a pair of generally vertical side margins, a horizontal top margin and a pair of convergent bottom margins. Each side margin of panel 12 is coupled with the adjacent inner surfaces of the adjacent side panel 14 or 16 by L-shaped members 42 (FIG. 3*a*) or by a channel member secured in any suitable manner, such as by fasteners. Since members 42 form a channel, the vertical side margins of panel 12 are slidable into the channels formed by both pairs of members 42 until the bottom margins of the transom panel engage or are adjacent to the upper surfaces of respective bottom panels 18 and 20.

Figure 3:
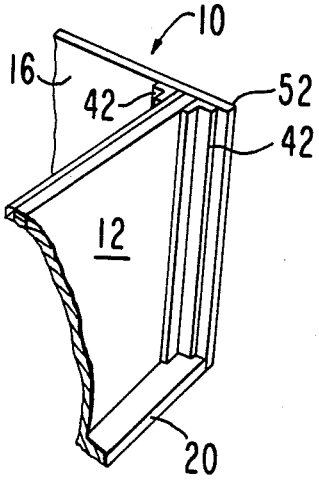
FIG. 3 is a view similar to FIG. 2 but showing the flexible sheet used for sealing the open rear end of the boat.
Figure 3A:
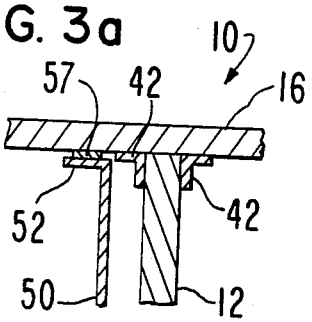
FIG. 3*a* is a fragmentary top plan view of the transom panel, showing the way in which it is removably mounted on the boat.
Figure 7:
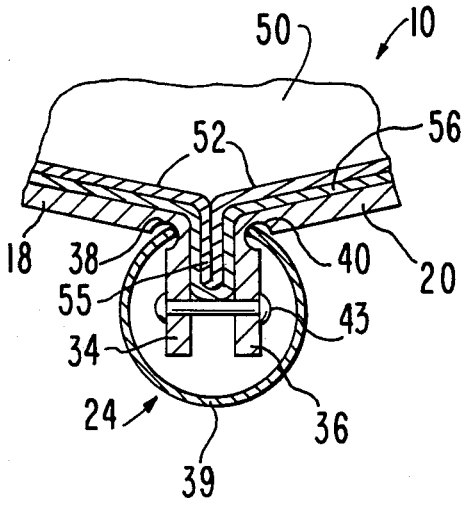
FIG. 7 is a schematic view, somewhat enlarged, of the sealing strip for sealing the sealing sheet to the bottom panels of the boat.

A sealing diaphram or sheet 50 is provided with boat 10 to seal the open rear end of the boat. To this end, sheet 50 is flexible, is of water impervious material, such as a suitable plastic, and is of a size to span the distance between side panels 14 and 16 as shown in FIG. 5. The height of sheet 50 is substantially the same as the height of transom panel 12, and the sheet 50 has side flanges 52 and bottom flanges 54 which are secured by a doublebacked adhesive tape 56 (FIG. 7), then stapled or electrically bonded to the inner surfaces of adjacent panels of boat 10. Members 42 are rearwardly of sheet 50 as shown in FIG. 3*a*. Thus, the transom panel can be readily slid into and out of a position spanning the distance between side panels 14 and 16 when the boat is expanded in the manner shown in FIG. 1.

Figure 4:
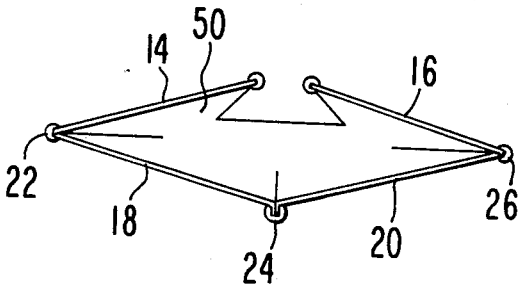
FIG. 4 is an end elevational view, partly schematic, of the boat, showing the way in which it is collapsed when the sealing sheet is coupled to the boat.

Portions of sheet 50 near the bottom margins thereof are forced or poked into respective hinges 22, 24 and 26 as shown in FIG. 5. Such portions are denoted by the numerals 59, 55 and 58 and form parts of the bottom margin of the sheet. Portions (unnumbered) of the tape 56 are also forced into the hinges beneath portions 59, 55 and 58 of sheet 50. By virtue of the doublebacked adhesive tape 57 and the poked-in lower portions, 59, 55 and 58, the open rear end of the boat is effectively sealed so that water cannot get into the boat past the transom panel. The sheet 50 is permanently coupled to the boat panels 14, 16, 18 and 20 and folds or bends as shown in FIG. 4 when the boat is collapsed.

In use, boat 10 is normally collapsed, whereupon the boat panels can be separated from each other to expand the boat, following which the panel 12 as put into place by being slid into the open tops of channels formed by members 42. The panel 12 is moved downwardly into the channels into the operative position shown in FIGS. 2 and 3, the sealing sheet having been assembled by doublebacked adhesive tape 56 at the time the boat is constructed. With the transom panel 12 in place as shown in FIGS. 1–3, an outboard motor can be placed onto the transom panel and operated after seat boards 28 and 30 have been placed in the boat as shown in FIG. 1 in spanning relationship to stiffeners 32. The boat is now ready for use.

Following use of the boat, the outboard motor can be removed from transom panel 12, following which the transom panel can be lifted out of the channels formed by members 42, and the boat can then be collapsed into the condition in which the panels are side by side. FIG. 4 shows the boat before the side panels are moved in between the bottom panels of the boat. During the collapsing of the boat, sealing sheet 50, being flexible, is moved into the spaces between adjacent panels as shown in FIG. 4.

Figure 9:
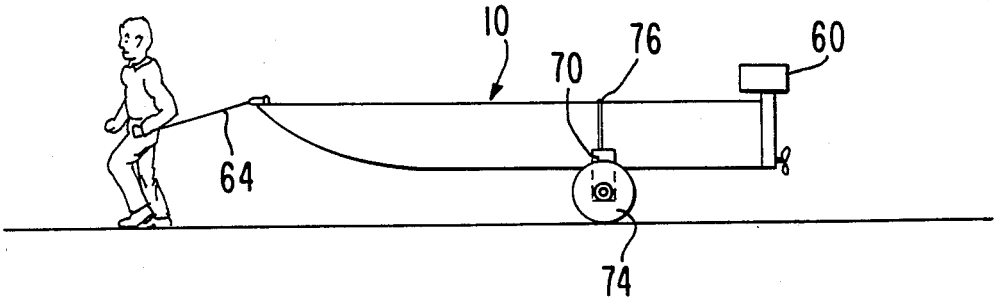
FIG. 9 is a schematic view of the wheeled attachment of FIG. 8 mounted on the boat and being movable over land.

With the boat expanded and carrying an outboard motor 60 as shown in FIG. 9, the boat can be placed on a carriage 62 and pulled by means of a tow line 64 from place to place over and without having to remove the outboard motor 60.

Figure 8:
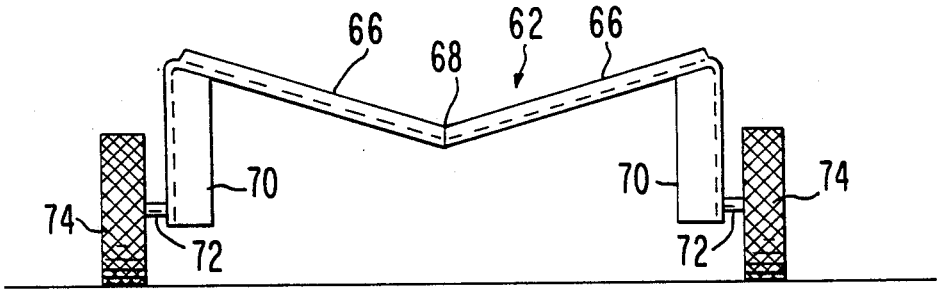
FIG. 8 is a rear elevational view of a wheeled attachment for the boat to make it movable over land.

Carriage 62 includes a pair of members 66 which are joined at their center point 68 and extend upwardly and outwardly from the center point as shown in FIG. 8. A pair of vertical legs 70 are rigidly secured to and extend downwardly from the outer ends of members 66. Each leg 70 has a shaft 72 for rotatably mounting a wheel 74 thereon. The boat 10 is light enough even with motor 60 on it to be lifted by a single person onto the carriage, following which a tie-down cord 76 can be removably mounted on the members 66 around boat 10 as shown in FIGS. 8 and 9 to releasably secure the boat to the carriage 62.

I claim:

1. A boat comprising:

an elongated collapsible hull having a pair of bottom panels extending longitudinally of the hull, a first hinge hingedly interconnecting the bottom panels, there being a pair of side panels and a pair of second hinges for hingedly connecting the side panels to respective bottom panels and extending longitudinally thereof, said hull being movable from a collapsed condition in which the panels are in substantially face-to-face relationship to an expanded condition in which the panels extend outwardly from each other, said panels presenting an open rear end for the hull when the hull is in its expanded condition;

a transom panel removably mounted on the hull across the open rear end when the hull is in its expanded condition; and means coupled with the hull forwardly of the transom panel for sealing the open rear end thereof, said sealing means including a flexible sheet impervious to water and having bottom and side flanges, and double backed adhesive tape means for securing the flanges of the sheet to adjacent panels of the hull, said sheet and said tape means having respective portions extending into the hinges in sealing relationship to said panels when the hull is in its expanded condition.

2. A boat as set forth in claim 1, wherein the transom panel has a pair of side margins, and including means on the hull rearwardly of the sheet for shiftably receiving the side margins of the transom panel, whereby the transom panel is removably mounted on the hull.

3. A boat as set forth in claim 2, wherein said receiving means includes means independent of the sheet defining a channel for each side margin, respectively, of the transom panel, the channels being adjacent to respective side panels of the hull.

4. A boat as set forth in claim 3, wherein said means defining each channel includes a pair of spaced, L-shaped members secured to the inner surface of a respective side panel near the rear end thereof.

5. A boat as set forth in claim 1, wherein is included an elongated stiffener for each side panel, respectively, the stiffeners being secured to the inner surfaces of respective side panels and extending longitudinally thereof.

6. A boat as set forth in claim 5, wherein the stiffeners have means thereon for mounting a seat board on the hull.

* * * * *